US008408035B2

(12) United States Patent
Schuster et al.

(10) Patent No.: US 8,408,035 B2
(45) Date of Patent: Apr. 2, 2013

(54) METHOD OF AND APPARATUS FOR HOT ROLLING A THIN SILICON-STEEL WORKPIECE INTO SHEET STEEL

(75) Inventors: Ingo Schuster, Willich (DE); Christoph Klein, Kreuztal (DE); Mario Sucker, Duesseldorf (DE); Heribert Neifer, Dinslaken (DE)

(73) Assignee: SMS Siemag AG, Duesseldorf (DE)

( * ) Notice: Subject to any disclaimer, the term of this patent is extended or adjusted under 35 U.S.C. 154(b) by 991 days.

(21) Appl. No.: 12/306,277

(22) PCT Filed: Jun. 22, 2007

(86) PCT No.: PCT/EP2007/005530

§ 371 (c)(1),
(2), (4) Date: May 15, 2009

(87) PCT Pub. No.: WO2008/000396

PCT Pub. Date: Jan. 3, 2008

(65) Prior Publication Data

US 2009/0301157 A1 Dec. 10, 2009

(30) Foreign Application Priority Data

Jun. 26, 2006 (DE) ..... 10 2006 029 589
Feb. 1, 2007 (DE) ..... 10 2007 005 015

(51) Int. Cl.
*B21B 27/06* (2006.01)

(52) U.S. Cl. ..... 72/200; 72/201

(58) Field of Classification Search ..... 72/200–202
See application file for complete search history.

(56) References Cited

U.S. PATENT DOCUMENTS 3,872,704 A * 3/1975 Ohya et al. ..... 72/364
5,261,971 A 11/1993 Yoshitomi ..... 148/111
5,307,864 A 5/1994 Arvedi ..... 164/476

(Continued)

FOREIGN PATENT DOCUMENTS

DE 3150946 7/1983
DE 4311150 12/1993

(Continued)

OTHER PUBLICATIONS

"Bandgiessen nach dem Zwei-Rollen Verfahren—Stand der Entwicklung bei der Thyssen Stahl AG" H. Litterscheidt et al, *Stahl und Eisen* vol. 111, No. 2, 1991, p. 61-66.

(Continued)

*Primary Examiner* — Teresa M Ekiert
(74) *Attorney, Agent, or Firm* — Andrew Wilford

(57) ABSTRACT

The invention relates to a method and a system for the production of hot-rolled strip silicon-alloy steel for further processing into grain-oriented sheets, such as electrical sheets, wherein a cast product, in this case a thin slab, for example, with a maximum thickness of 120 mm, is subjected to thermal pretreatment and to a subsequent rolling process on a hot-rolling line to set a desired recrystallization state. The invention proposes an intake temperature ($T_{in}$) of the cast product (2) into the hot-rolling line (9*a* or 9*b*) of at least 1200° C., and preferably in excess of 1250° C., which should be controlled during pretreatment by adding at least one preheating stage (3) and one intensive heating stage (6) to ensure the final rolling temperature ($T_{FR}$).

13 Claims, 1 Drawing Sheet

U.S. PATENT DOCUMENTS

| | | | | |
|---|---|---|---|---|
| 5,802,902 | A | 9/1998 | Rosenthal | |
| 5,885,371 | A | 3/1999 | Komatsubara | 148/113 |
| 6,436,205 | B1 | 8/2002 | Behrens | 148/541 |
| 2005/0072499 | A1 | 4/2005 | Schuster | 148/609 |
| 2008/0000559 | A1 | 1/2008 | Schuster | 148/541 |

FOREIGN PATENT DOCUMENTS

| | | |
|---|---|---|
| DE | 10060950 | 6/2002 |

OTHER PUBLICATIONS

"MarkBlatt 401—Elektroband und -blech" *Stahl-Informations-Zentrum*, Duesseldorf, Germany, 2005, p. 9-10.

"An overview of the production for electric steel" AISTech2005—Proceedings of the Iron &Steel Technology Conference, vol. 1, Mar. 2005.

* cited by examiner

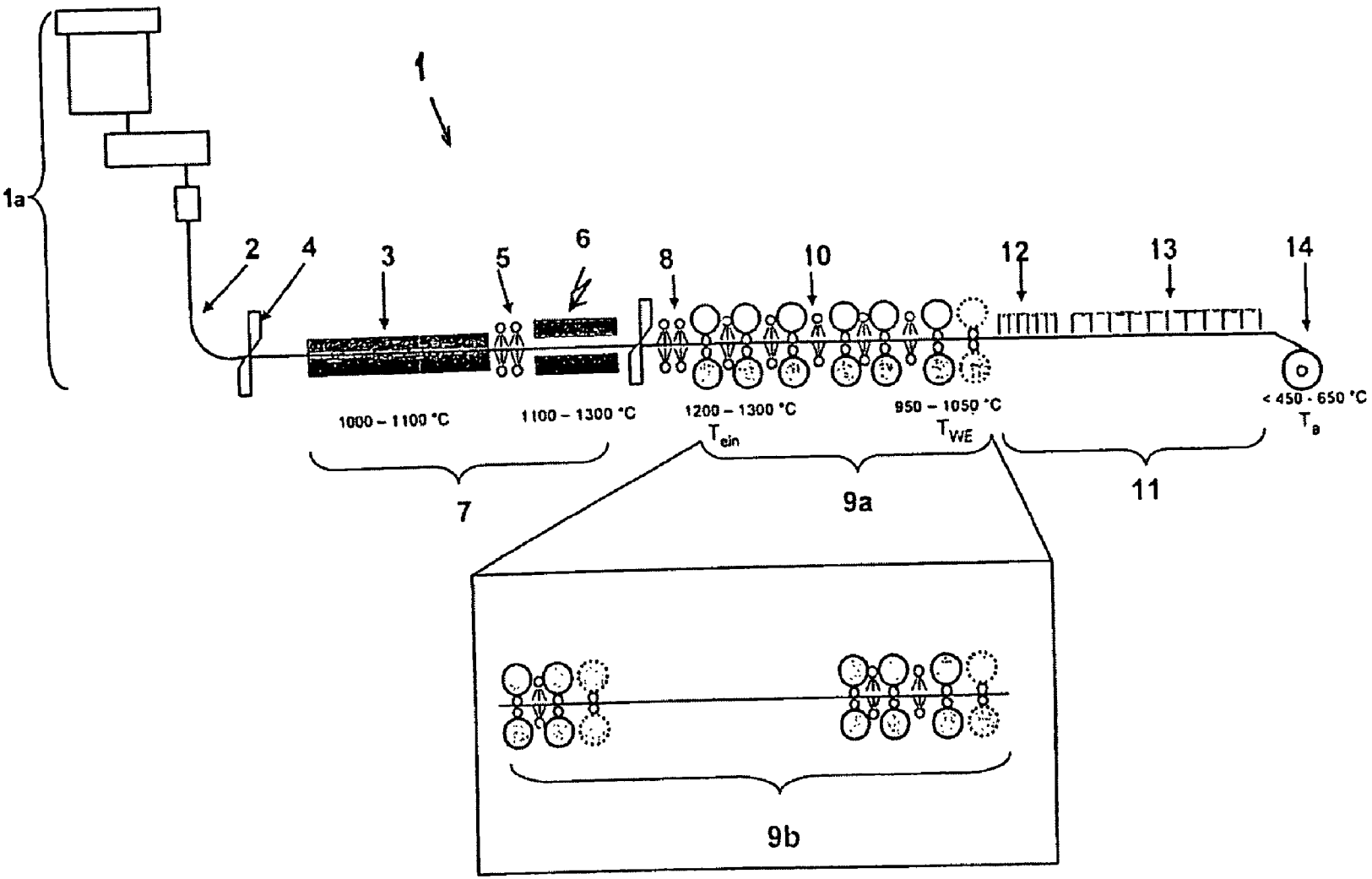
1
1a
2
3
4
5
6
7
8
9a
9b
10
11
12
13
14
1000 – 1100 °C
1100 – 1300 °C
1200 – 1300 °C
$T_{ein}$
950 – 1050 °C
$T_{WE}$
< 450 - 650 °C
$T_B$

METHOD OF AND APPARATUS FOR HOT ROLLING A THIN SILICON-STEEL WORKPIECE INTO SHEET STEEL

CROSS REFERENCE TO RELATED APPLICATIONS

This application is the US-national stage of PCT application PCT/EP2007/005530, filed 22 Jun. 2007, published 3 Jan. 2008 as WO2008/000396, and claiming the priority of German patent application 102006029589.7 itself filed 26 Jun. 2006 and German patent application 102007005015.3 itself filed 1 Feb. 2007, whose entire disclosures are herewith incorporated by reference.

FIELD OF THE INVENTION

The invention relates to a method of and an apparatus for making hot-strip starting material of silicon-alloy steel for further processing to grain-oriented sheets such as, for example, electro sheet metal. The further processing is not subject matter of the present invention; it takes place in a cold-rolling mill.

BACKGROUND OF THE INVENTION

Various methods and apparatuses of the generic type are known from the state of the art; the following two publications are referred to by way of example:

Methods and apparatuses for the rolling of strips and sheets from the casting heat are known, for example, described in Stahl & Eisen vol. 2, 1993, p. 37ff. In the mill described in it a thin slab is produced by a billet-casting machine with a special ingot mold, divided into sections, and fed for temperature compensation to a roller heath furnace. The slab is subsequently accelerated to the distinctly higher entry speed of the following rolling train, descaled and supplied to the rolling train. In a stationary production operation with a casting rate of 5.5 m/min the thin slab reaches the roller-hearth furnace with an average temperature of 1080° C. The energy necessary for the rolling method is thus supplied almost completely from the heat in the cast billet. In the rolling mill the temperatures are controlled by changing the rolling speed, by cooling and by roller contact, so that a final rolling temperature of 880° C. is attained. A slow cooling off in a cooling stretch follows as well as a subsequent winding up.

Multistage temperature-adjustment systems for heating up a cast workpiece before it enters into a rolling train are known from EP 1,469,954 [US 2005/0072499 & 2008/0000559].

Furthermore, EP 0,415,987 9 [U.S. Pat. No. 5,307,864] teaches a method of continuously making strip steel or steel sheet from thin slabs approximately 50 mm thick, which thin slabs are produced on continuous-casting equipment with a horizontal output. The method comprises the steps of: Rolling the thin slabs after hardening of the billet in a curved guide at temperatures of more than 1100° C., cooling the slabs during irradiation or descaling, inductive reheating to a temperature of approximately 1100° C. as well as rolling of the thin slab in at least one rolling train. Temperature is adjusted in the slab by heating in such a manner that a temperature gradient is adjusted on the deformation apparatuses on the rolling train in such a manner that during the first pass into the rolling stand the temperature is within the range that is still sufficient for good deformation. Here, the temperature of the rolled stock has dropped, for example, to 988° C. in the third and last rolling stand of the rolling train and is sufficient as first pass temperature for the last deformation step. The rolled stock leaves the last rolling stand with a temperature of 953° C. or less and is then separated at an even lower temperature into the desired lengths, stacked or wound. If required, one or more stages of inductive intermediate heating can be provided between the individual rolling stands.

Both known methods have the common feature that the entry temperature into the finish-rolling stage is adjusted in such a manner that the set final rolling temperature can be maintained.

OBJECT OF THE INVENTION

Starting from EP 0,415,987, the basic object of the invention is to use the known heat-treatment method and apparatus to produce hot-strip starting material from Si-alloyed steels for further processing to grain-oriented sheets.

SUMMARY OF THE INVENTION

The problem is solved by the method wherein a cast strand workpiece, for example a thin slab of silicon-alloy steel is subjected in a first step to a preheating treatment and in a second step the preheated cast workpiece is subjected to a rolling procedure in a hot-rolling train, such that the rolled stock is converted into a recrystallization state suitable for subsequent further processing at a desired final rolling temperature. According to the invention the cast workpiece is preheated by being run through at least one preheating stage and one intensive-heating stage in order to adjust the final rolling temperature of the rolled stock in the hot-rolling train. It is heated in this manner to an entry temperature of at least 1200° C. for before entering the hot-rolling train.

For the first time an entry temperature into the finish train is adjusted in a simple manner with the method in accordance with the invention that ensures a favorable separation morphology in the rolled stock. One-stage temperature-adjustment systems known in the prior art are not capable of heating the cast workpiece to the high temperature of preferably above 1250° C. entry temperature into the rolling train required for adjustment of the recrystallization state desired/required here. The high temperatures are advantageously achieved in the inventive method with a two-stage preheating of the cast workpiece comprising a primary-energy fired stage and an inductively heated stage. The two-stage heat pretreatment according to the invention has the further advantage that it allows the cast workpiece to be heated not only, if required, to a temperature above 1250° C. but also to lower entry temperatures if this should be required for setting other desired structural states or recrystallization states; and to this extent the method of this invention can be used universally.

Control of the temperature in the subsequent finish rolling train is set in accordance with the final structure to be achieved and is set via a combination of rolling speed and the use of intermediate structure cooling.

In a preferred embodiment of the method of the present invention, the final rolling temperature ($T_{WE}$) and the final rolling speed of the rolled stock are adjusted to values at which no complete recrystallization of the steel takes place any more and the rolled stock is quenched after the last pass in the hot-rolling train from the final rolling temperature ($T_{WE}$) to a temperature ($T_A$) that ensures setting and freezing of a desired recrystallization state via the strip thickness. It is recommended here in accordance with a further design feature of the present invention that the final rolling temperature ($T_{WE}$) of the rolled stock be adjusted to a temperature of at least 950° C., preferably above 1000° C., and then subsequently, preferably immediately afterward, the rolled stock is quenched to a temperature ($T_A$) of at the most 650° C., preferably below 600° C., especially preferably below 450° C. within 10 sec. This suppresses complete recrystallization of the hot strip. The amount of the recrystallized structure through the strip thickness is set by the selection of the winding temperature.

According to a further design feature of the present invention it is provided that in the preheating stage the temperature of the cast workpiece is set to values between 1000 and 1100° C. and that in the following intensive-heating stage the temperature is raised to values of 1250° C. In a preferred embodiment the preheating stage is carried out here in a gas-heated or oil-heated furnace and the subsequent intensive-heating stage in an induction-heating stage. This has the special advantage that preheating can take place in a roller-hearth furnace whereas the heating step up to a temperature above 1200° C. is shifted into an inductive heating zone. This prevents the roller-hearth furnace from being stressed too much, which could possibly result in its thermal destruction.

In order to avoid the disadvantageous effect of a heavily heated primary scale layer on the surface of the rolled stock, the slab surface is descaled. To this end and in accordance with a is further design feature of the present invention descaling is carried out in a descaler between the preheating stage and the intensive stage. Adjustment of the entry temperature into the finish-rolling stage therefore takes place subsequently with the induction-heating stage. The finish-rolling stage can consist here of a single-stand or multistand roughing train and of a multistand final train. The distance between these two can be bridged by a roller bed or a tunnel oven.

In order to further improve the surface quality, a further design feature of the present invention provides that a further descaling is carried out in a second descaling stage downstream of the intensive-heating stage.

In addition, scale removal is carried out by itself or in addition to the cited descaling upstream of the roller-hearth furnace in order to protect the rollers of the furnace from accumulations of scale and the slab bottom from undesired markings and to improve the thermal transfer into the slab.

The above-cited object of the invention is furthermore attained by the apparatus of the instant invention. As regards the advantages accruing from it, in order to avoid repetitions the above-described advantages of the method in accordance with the invention are referred to.

In the preferred embodiment of the apparatus in accordance with the invention the device for cooling the rolled stock comprises elements for quenching the rolled stock to a temperature below 600° C., preferably below 450° C.

It is recommended according to a further design feature of the present invention that the hot-rolling train is a compact finish train. An alternative design feature provides that the hot-rolling train is divided into at least one roughing train and at least one final rolling train.

BRIEF DESCRIPTION OF THE DRAWING

Further advantages and details of the invention are disclosed in the following description in which the embodiments of the invention shown in the figures are explained in detail. In addition to the above-cited combinations of features, features that are alone or in other combinations are essential for the invention. The sole FIGURE of the drawing is a schematic view of a plan for carrying out the method in accordance with the invention.

DETAILED DESCRIPTION

FIG. 1 shows a mill 1 for manufacturing rolled stock in the form of sheets or strips of silicon-alloyed steel for further processing to grain-oriented sheets such as, for example, electro sheet metal that are heat-treated and rolled to room temperature without intermediate cooling so that the rolled stock subsequently has the desired structural properties. The mill 1 comprises a billet caster 1*a* (means for casting). The billet in the form of a strand workpiece 2 cast close to the final dimensions is cut upstream (relative to travel direction from left to right in the drawing) of the roller-hearth furnace 3 by shears 4 into slabs that then, still at the casting temperature, enter directly into the roller-hearth furnace 3 in order to be heated to a temperature of 1000 to 1100° C. and for temperature equalization. The slabs are preferably thin slabs with a thickness of up to 120 mm. The heated slabs subsequently preferably run through a descaler 5 and then into an intensive-heating stage 6. Here, the slabs are heated in a short, rapid heating method to an entry temperature of 1100 to 1300° C., preferably above 1250° C. The preheating stage 3 is a gas-heated or oil-heated furnace such as a roller-hearth furnace 3 and the following intensive-heating stage 6 is an induction heater. The intensive-heating stage 6 must be set up so as to ensure an entry temperature $T_{ein}$ of cast workpiece 2 into the rolling mill of more than 1200° C. The preheating stage 3 and intensive-heating stage 6 form a temperature-adjustment system 7. The heat-treatment means comprises the preheating stage 3, intensive-heating stage 6 as well as intermediate cooler frames 10.

After passing through the intensive-heating stage 6 the cast workpiece(s) 2 are descaled again in a second descaling stage 8 and introduced into a hot-rolling train 9*a* or 9*b* having a succession of separate roll stands. The hot-rolling train 9*a* or 9*b* can be a compact finish train or be divided into a roughing train and into final train 9*b*. The number of stands in each of the two partial trains is not fixed.

The method in accordance with the invention provides that in order to adjust the final rolling temperature $T_{WE}$, an entry temperature $T_{ein}$ of the cast workpiece 2 into the hot-rolling train 9*a* or 9*b* of the rolling mill of at least 1200° C., preferably above 1250° C., is set by a multistage heat treatment, during which the cast strand coming directly from the casting heat is directly preheated. The multistage heating pretreatment is done by the temperature-adjustment system 7 that comprises the preheating stage 3 for preheating the cast workpiece 2 and comprises the intensive-heating stage 6 for adjusting the entry temperature $T_{ein}$ of the cast workpiece 2 into the hot-rolling train 9*a* or 9*b*.

In the method according to the invention the final rolling temperature $T_{WE}$ the final rolling speed of the rolled stock are set to values at which no complete recrystallization of the steel takes place any more. The rolled stock is quenched at 12 after the hot-rolling train in a post-heating treatment from the final rolling temperature $T_{WE}$ a temperature $T_A$ that ensures the desired recrystallization state of the rolled stock at the end of the hot-rolling train through the strip thickness. The final rolling temperature $T_{WE}$ the rolled stock is set at 13 to a temperature of at least 950° C., preferably above 1000° C., and the rolled stock is subsequently quenched to a temperature $T_A$ of at most 650° C., preferably below 600° C. and especially preferably below 450° C. within 10 sec.

The post-heating treatment after rolling is a combination of a rapid cooler 12 and normal cooling beams with water cooling 13. The cooled-down rolled stock is subsequently wound on a winding apparatus 14 forming the final element of a conveyor means for passing the workpiece 2 from the casting means 1*a* through the stages 3 and 6 and through the roll train 10 and temperature-adjusting stages 12 and 13.

The invention claimed is:

1. A method of making sheet steel, the method comprising the steps of:

casting a thin slab workpiece of silicon-alloy steel;

passing the cast workpiece through a preheating stage;

passing the workpiece downstream of the preheating stage through an intensive-heating stage and thereby raising the workpiece temperature to an entry temperature of at least 1200° C.;

feeding the heated workpiece at the entry temperature into a hot-rolling train having a plurality of roll stands and frame coolers between the roll stands;

descaling the workpiece between the preheating stage and the hot-rolling train; and hot-rolling the workpiece in the train at such a speed and using the frame coolers so as to reduce workpiece thickness, lower workpiece temperature to a final rolling temperature, and convert the workpiece into a recrystallization state suitable for subsequent further processing into a grain-oriented sheet.

2. The method defined in claim 1 wherein the workpiece moves continuously after casting through the preheating stage, the intensive-heating stage, a descaler carrying out the descaling, and the hot-rolling train.

3. The method defined in claim 2 wherein the workpiece is continuously cast.

4. The method defined in claim 1 wherein the workpiece is hot-rolled such that immediately after exiting the hot-rolling train the workpiece is at a temperature and is moving at such a speed that its steel is no longer capable of recrystallization and a predetermined recrystallization is generally uniform through the cross section of the workpiece.

5. The method defined in claim 1 wherein the final rolling temperature is at least 950° C.

6. The method defined in claim 5, further comprising the step after hot-rolling of:

cooling the workpiece to below 650° C.

7. The method defined in claim 1 wherein in the preheating stage the workpiece is heated to between 1000 and 1100° C. and in the intensive-heating stage the workpiece is heated to more than 1250° C.

8. The method defined in claim 1 wherein the preheating stage is gas- or oil-fired and the intensive-heating stage is inductive.

9. The method defined in claim 1 wherein the descaling is done between the preheating and the intensive-heating stages.

10. The method defined in claim 1 wherein descaling is also done between the intensive-heating stage and the hot-rolling train.

11. An apparatus for making sheet steel, the apparatus comprising:

means for casting a thin slab workpiece of silicon-alloy steel;

means for passing the workpiece through a preheating stage and a separate intensive-heating stage downstream of the preheating stage for raising the workpiece temperature to an entry temperature of at least 1200° C.;

hot-rolling means downstream of the intensive-heating stage having a succession of roll stands and frame coolers between the roll stands for receiving the workpiece at the entry temperature for hot-rolling the workpiece, reducing workpiece thickness, lowering workpiece temperature to a final rolling temperature, and converting the workpiece into a recrystallization state suitable for subsequent further processing into a grain-oriented sheet, the workpiece temperature being controlled by adjusting workpiece-travel speed through the roll stands and by using the frame coolers; and rapid and water-spray cooling means downstream of the hot-rolling means for cooling the workpiece to a temperature below 600° C.

12. The apparatus defined in claim 11 wherein the hot-rolling means included a compact hot-rolling train.

13. The apparatus defined in claim 12 wherein the rolling train has separate upstream and downstream roll-stand arrays relative to a travel direction of the workpiece.

* * * * *